US008642876B2

(12) United States Patent
DeRoche et al.

(10) Patent No.: US 8,642,876 B2
(45) Date of Patent: Feb. 4, 2014

(54) MICROPROCESSOR CONTROLLED, ACCELEROMETER BASED GUITAR PICKUP SWITCHING SYSTEM

(75) Inventors: Leonard A. DeRoche, New Boston, NH (US); Paul J. Schwab, Nashua, NH (US); Nelson Spike Jones, Weare, NH (US); Gerald Griffin, Mont Vernon, NH (US); John B. Stevens, Weare, NH (US)

(73) Assignee: Rockerswitch LLC, Weare, NH (US)

( * ) Notice: Subject to any disclaimer, the term of this patent is extended or adjusted under 35 U.S.C. 154(b) by 183 days.

(21) Appl. No.: 13/396,960

(22) Filed: Feb. 15, 2012

(65) Prior Publication Data

US 2012/0210849 A1 Aug. 23, 2012

Related U.S. Application Data

(60) Provisional application No. 61/443,906, filed on Feb. 17, 2011.

(51) Int. Cl.
*G10H 1/06* (2006.01)

(52) U.S. Cl.
USPC ..... 84/723; 84/735; 84/742

(58) Field of Classification Search
USPC ..... 84/723
See application file for complete search history.

(56) References Cited

U.S. PATENT DOCUMENTS

| | | | | | |
|---|---|---|---|---|---|
| 4,711,149 | A * | 12/1987 | Starr | ..... | 84/742 |
| 4,817,486 | A * | 4/1989 | Saunders | ..... | 84/725 |
| 5,834,671 | A * | 11/1998 | Phoenix | ..... | 84/645 |
| 5,990,408 | A * | 11/1999 | Hasebe | ..... | 84/723 |
| 7,667,129 | B2 * | 2/2010 | Chidlaw et al. | ..... | 84/723 |
| 2005/0211081 | A1 * | 9/2005 | Bro et al. | ..... | 84/737 |
| 2008/0034950 | A1 * | 2/2008 | Ambrosino | ..... | 84/742 |
| 2010/0083808 | A1 * | 4/2010 | Sullivan | ..... | 84/315 |
| 2012/0024129 | A1 * | 2/2012 | Ball et al. | ..... | 84/602 |

* cited by examiner

*Primary Examiner* — Christopher Uhlir
(74) *Attorney, Agent, or Firm* — Maine Cernota & Rardin

(57) ABSTRACT

An apparatus and method for selecting combinations of pickups on a guitar or other stringed instrument allows a performer to control the pickup selections without interrupting instrument play. Combinations of pickups are selected by a processor according to measurements of orientation, position, and/or rate of movement made by an accelerometer. The accelerometer measurements can be filtered. Any or all elements of the system can be contained in a hollow space within the instrument. A manual control can be included to override the processor. Pickup combinations and/or accelerometer measurement ranges can be specified by manual controls while in a training mode. In a sequential mode, pickup combinations are selected in a preset order and for preset time periods. The accelerometer sampling rate can be between 1000 and 100 samples per second, and the sampled data can be stored in an 11 by 11 array.

22 Claims, 6 Drawing Sheets

MICROPROCESSOR CONTROLLED, ACCELEROMETER BASED GUITAR PICKUP SWITCHING SYSTEM

RELATED APPLICATIONS

This application claims the benefit of U.S. Provisional Application No. 61/443,906, filed Feb. 17, 2011, herein incorporated by reference in its entirety for all purposes.

FIELD OF THE INVENTION

The invention relates to guitar pickup switching systems, and more particularly to microprocessor controlled, accelerometer based guitar pickup switching systems.

BACKGROUND OF THE INVENTION

Electric guitars generally have a number of pickups, which are electromagnetic sensors that convert the vibration of the plucked strings into an electrical signal that represents the sound associated with the string vibration. These electrical signals can then be amplified and played out through a speaker. The pickups are positioned at different locations on the body of the instrument, typically at the bridge, the neck and the middle (between the bridge and the neck). Although each pickup is reacting to the same set of strings, the sounds will be somewhat different at each pickup because of the varying positions of the pickups relative to the body of the instrument.

The performer can exploit these sound variations and effects by selecting from among the pickups either individually or in combination. To do so, however, requires manual manipulation of a switch. This switch is typically a five way switch located on the face of the instrument. The performer is forced, therefore, to interrupt his picking hand in order to make adjustments to the switch settings. This has an adverse impact on the playing of the instrument.

What is needed, therefore, is a way to control the selection of the pickups without requiring the performer to interrupt his playing by forcing the use of either hand to manipulate a switch or control knob.

SUMMARY OF THE INVENTION

One general aspect of the present invention is a microprocessor controlled, accelerometer based guitar pickup switching system. It should be noted that unless the context requires otherwise the term "accelerometer" is used herein to refer to any device or sensor that can be used to determine an angular orientation, an acceleration, or a position An embodiment of the invention allows the performer to select a pickup or combination of pickups based on the angle at which the guitar is held, thus eliminating any interruption of playing caused by the need to manipulate switches.

An accelerometer senses the angle of orientation of the instrument at periodic intervals. A processor reads these sensor measurements and possibly filters them for stability before determining an angle estimate. The filtering may be a hysteresis filter which takes into account previous angle history to improve the current angle estimate. Based on this estimate the processor may switch in a particular pickup or combination of pickups to be connected to an amplifier.

In an embodiment of the invention, the performer may train the processor to associate particular orientation angles with desired pickup combinations. There may also be provided a manual override switch to allow the performer to select pickups in the traditional manner.

The accelerometer, processor, switches and associated circuitry may all be located within a hollow portion of the instrument.

One general aspect of the present invention is a pickup switching system for a stringed instrument. The pickup switching system includes a stringed instrument, a plurality of pickups that detect vibrations of strings at a plurality of locations on the instrument, a plurality of switches that can direct outputs of the pickups to an audio amplifier system, an accelerometer fixed to the stringed instrument, where the term "accelerometer" refers herein to any device or sensor that can be used to determine an angular orientation, an acceleration, and/or a position, and a processor that is in electronic communication with the switches and the accelerometer, the processor being programmable so as to select different combinations of the pickups for output to the audio amplifier system according to measurements obtained from the accelerometer.

In embodiments, the stringed instrument is an electric guitar. In some embodiments, at least one of the pickup combinations is selected according to a comparison of an orientation of the instrument with a plurality of selectable orientation ranges. In other embodiments the processor can select up to five pickup combination corresponding to five ranges of accelerometer measurements.

In various embodiments the number of selectable ranges of accelerometer measurements can be changed by a user.

In certain embodiments the pickup combinations are selected based on applying a filter to a plurality of accelerometer measurements. In some of these embodiments the filter is simple averaging of sample values. In other of these embodiments the filter is a hysteresis filter. In still other of these embodiments, the output of the filter reacts slowly to changing inputs by taking into account a recent history of those inputs.

In various embodiments further include a manual pickup selection control that can be used to override the processor and manually select at least one combination of pickups for output to the audio amplifier system.

In certain embodiments, at least one of the accelerometer, the processor, and the switches is located within a hollow portion of the instrument.

In some embodiments, the processor can be programmed by activating a training mode of the processor and then storing training points in the processor by activating a training control during manipulation of the instrument, each training point corresponding to a specific combination of pickups to be selected. In some of these embodiments, for each training point the corresponding combination of pickups is defined by selecting the combination of pickups using a manual pickup selection control.

In various embodiments the accelerometer is sampled at a sampling rate that is between 1000 samples per second and 100 samples per second. In certain embodiments data obtained by sampling the accelerometer are stored in a data array of size 11 by 11.

In some embodiments, the processor is able to initiate a sequential switching process whereby combinations of pickups included in a specified sequence are sequentially selected at times separated by one or more specified time intervals. And in some of these embodiments the sequential switching process can be initiated by manipulating a control or signaling mechanism.

In embodiments, at least one of the pickup combinations is selected according to measurements of motional speed or acceleration obtained from the accelerometer.

In some embodiments, selectable modes of operation of the processor include processor controlled switching, manually controlled switching, selection of pickup combinations from an ordered series of combinations in ascending order, selection of pickup combinations from an ordered series of combinations in descending order, switching according to slow movements of the instrument, and/or switching according to rapid movements of the instrument.

In various embodiments at least one of the pickup combinations is selected according to a measurement of a translational position of the instrument. In some of these embodiments the translational position of the instrument is measured relative to a position of a foot pedal in wireless communication with the processor.

Another general aspect of the present invention is a method for switching between combinations of pickups that detect string vibrations on a stringed instrument. The method includes measuring at least one of an angular position, an acceleration, a rate of motion, and a translational position of the stringed instrument, selecting a combination of pickups according to the measurement, and directing outputs of the selected combination of pickups to an audio amplifier system.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

DETAILED DESCRIPTION

The invention is susceptible to many variations. Accordingly, the drawings and following description of various embodiments are to be regarded as illustrative in nature, and not as restrictive.

An embodiment of the invention provides a microprocessor controlled, accelerometer-based guitar pickup switching system that allows the performer to select a pickup or combination of pickups based on the angle at which the guitar is held. This eliminates any interruption in playing caused by the need to manipulate switches.

Figure 1:
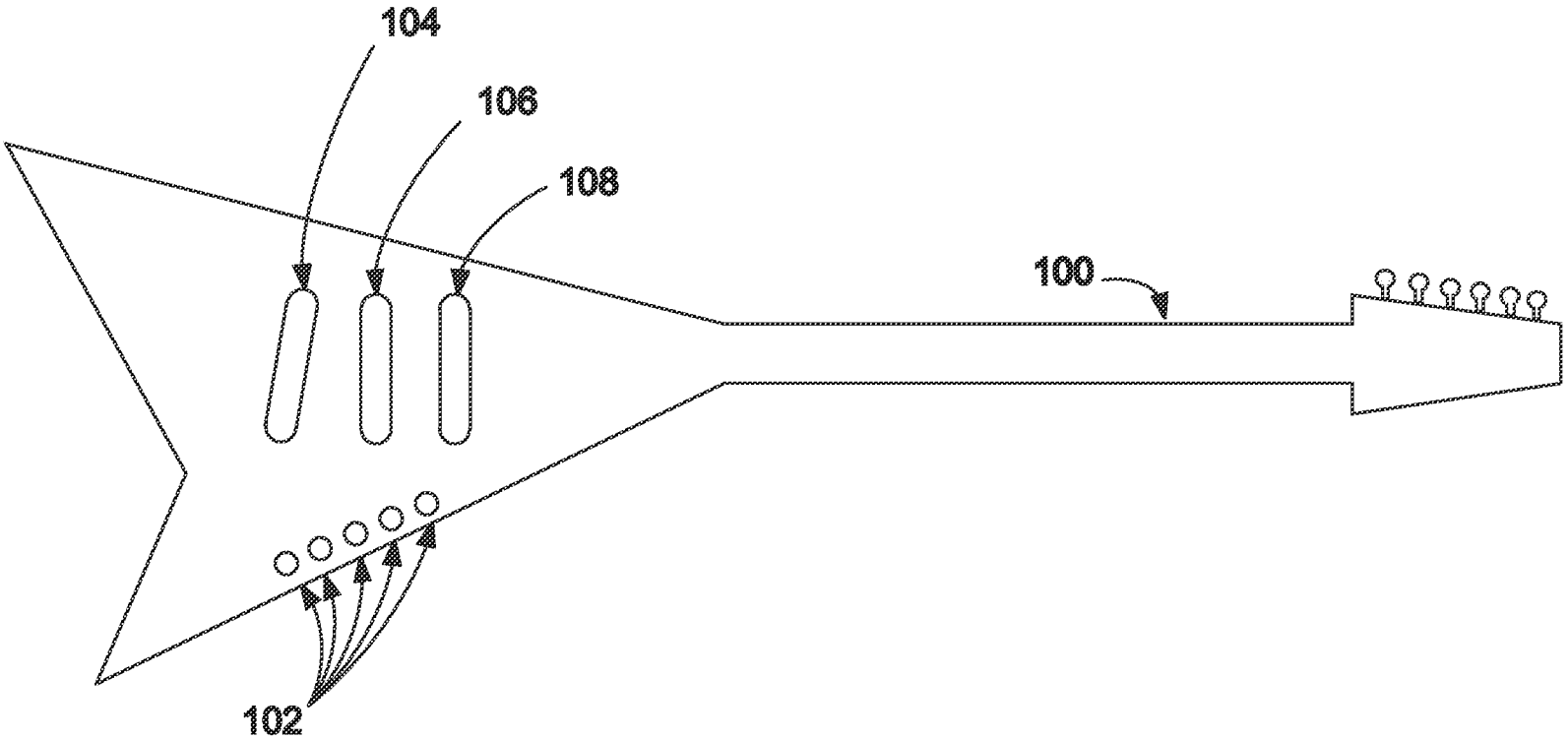
FIG. 1 is a front view of an electric guitar, according to an embodiment of the invention.

Referring now to FIG. 1, there is shown a front view of an electric guitar, according to an embodiment of the invention. Guitar 100 has a bridge pickup 104, a middle pickup 106, and a neck pickup 108. There is also a traditional style "5-way switch" 102. In various embodiments switch positions correspond to bridge pickup only, bridge and middle pickups, middle pickup only, middle and neck pickups or neck pickup only. In different embodiments, various types of switch or knob controls at suitable locations on the instrument are included that allow the performer to select any desired combination of pickups by interrupting the picking hand to manipulate the controls in the traditional manner.

Figure 2:
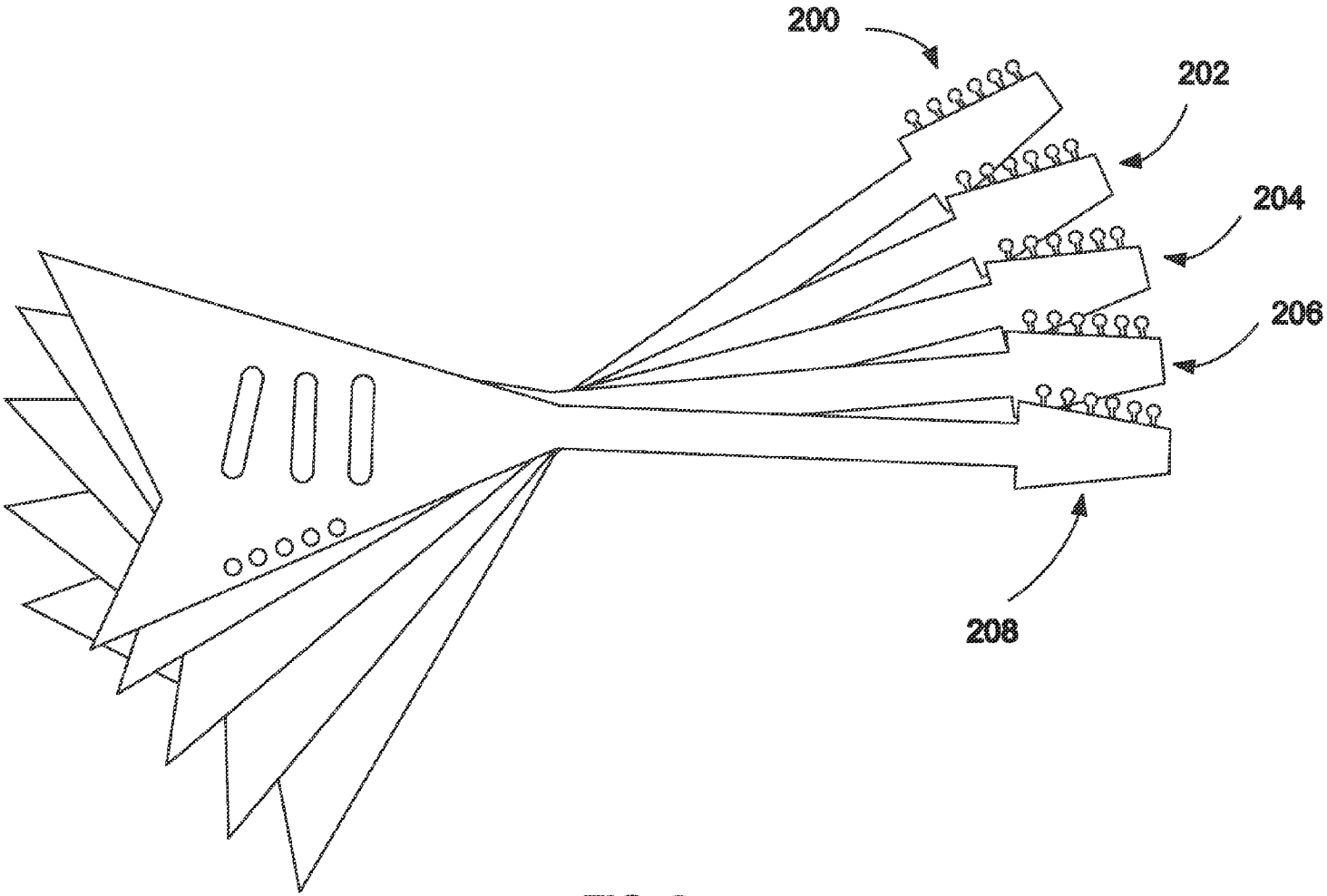
FIG. 2 is a front view of an electric guitar held at five different angles, according to an embodiment of the invention.

Referring now to FIG. 2, there is shown a front view of an electric guitar held at five different angles, according to an embodiment of the invention. In the embodiment of FIG. 2, the guitar includes an accelerometer which is used to sense the guitar's orientation, in combination with a microprocessor that can be programmed to associate each of the five angles 200, 202, 204, 206 and 208 with a particular pickup combination. It should be noted that unless the context requires otherwise the term "accelerometer" is used herein to refer to any device or sensor that can be used to determine an angular orientation, an acceleration, or a position.

In embodiments, the guitar can be trained to use different pickup combinations in response to the manner in which the performer moves the instrument while playing. For example, in training mode the guitar can be held at each respective orientation and the desired combination of pickups can be selected manually, thereby causing the microprocessor to associate the selected combination of pickups with the respective orientation when the guitar is no longer in training mode.

It is to be understood that in various embodiments the five angles shown in FIG. 2 do not necessarily represent specific angles, but rather five different angular ranges. It should also be understood that while the embodiment of FIG. 2 includes 5 angles, other embodiments include different numbers of angles, and that in some embodiments the number of selectable angles can be changed according to user requirements and preferences. The number of pickups also varies in different embodiments.

In various embodiments the training process may comprise the performer pushing a button to set his transition points during a calibration routine. The accelerometer readings for each for these transition points are then saved in memory for use during the performance.

Figure 3:
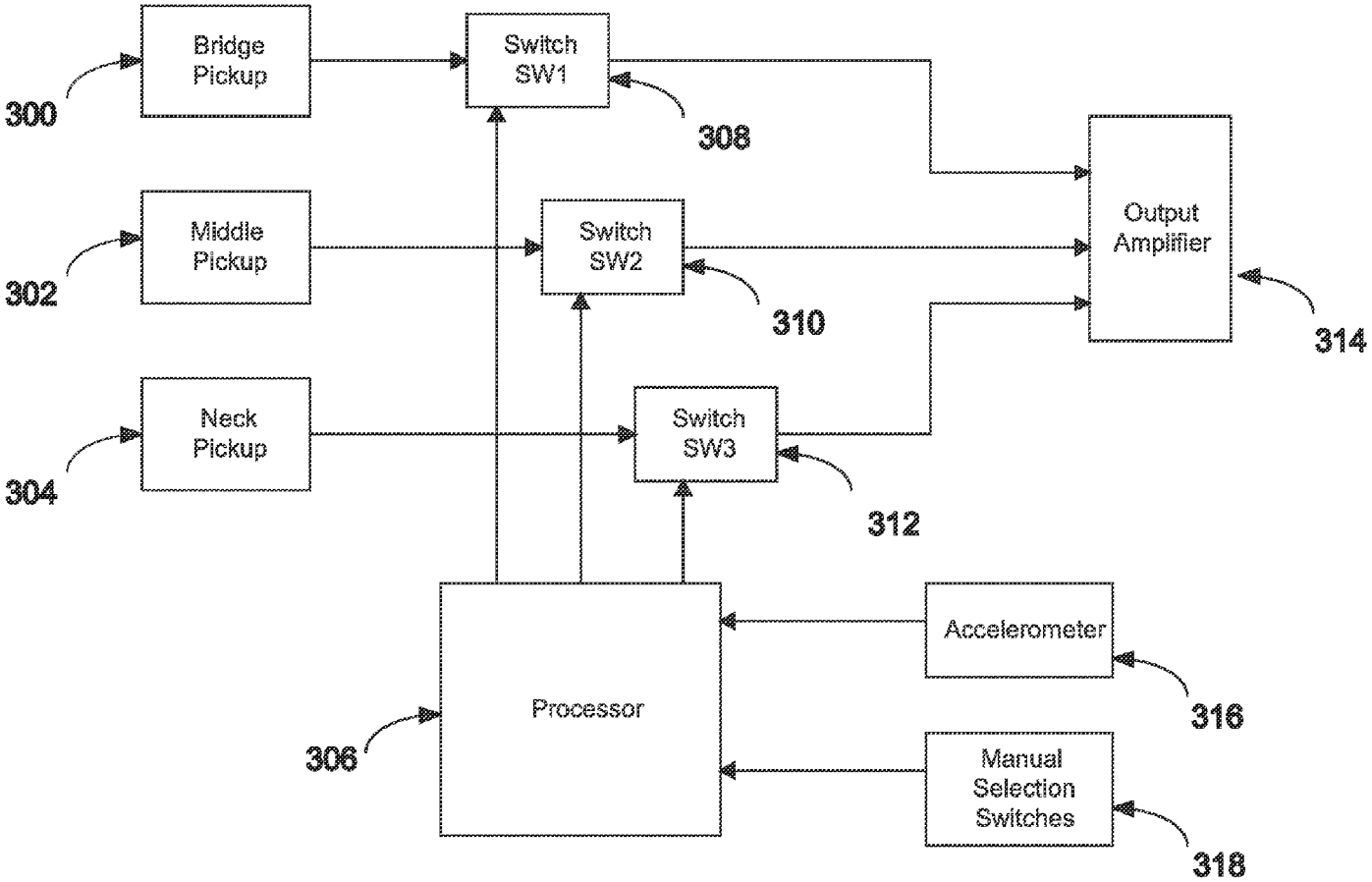
FIG. 3 is a system block diagram, according to an embodiment of the invention.

Referring now to FIG. 3, there is shown a system block diagram, according to an embodiment of the invention. Bridge pickup 300, middle pickup 302 and neck pickup 304 are electromagnetic sensors that convert the vibrations of the plucked strings into electrical signals that represent the sound associated with the string vibrations. Because the pickups are located in different positions on the instrument, they produce variations in the generated sound that the performer may wish to exploit.

Accelerometer 316 generates data according to the angle or orientation at which the guitar is being held, and transmits the data to processor 306, which filters the data to stabilize the readings. In some embodiments, the filtering is a simple averaging of sample values to smooth out the readings. In other embodiments, the filtering is a hysteresis filter, where the output of the filter reacts slowly to changing inputs by taking into account the recent history of those inputs. This feature can mitigate the effect of rapid switching back and forth when the guitar angle hovers between two angle regions.

Processor 306 then determines which pickup or combination of pickups should be used based on that angle data, and enables one or more of switches SW1 308, SW2 310 and SW3 312 to transmit their electrical signals to output amplifier 314. Manual selection switch 318 may also be used to override the accelerometer and force the selection of a desired pickup or combination of pickups. In some embodiments the manual selection switch 318 is the "5-way switch" 102 of FIG. 1.

In embodiments, the accelerometer and associated circuitry, including the processor, are located in a hollow section of the body of the instrument.

Figure 4:
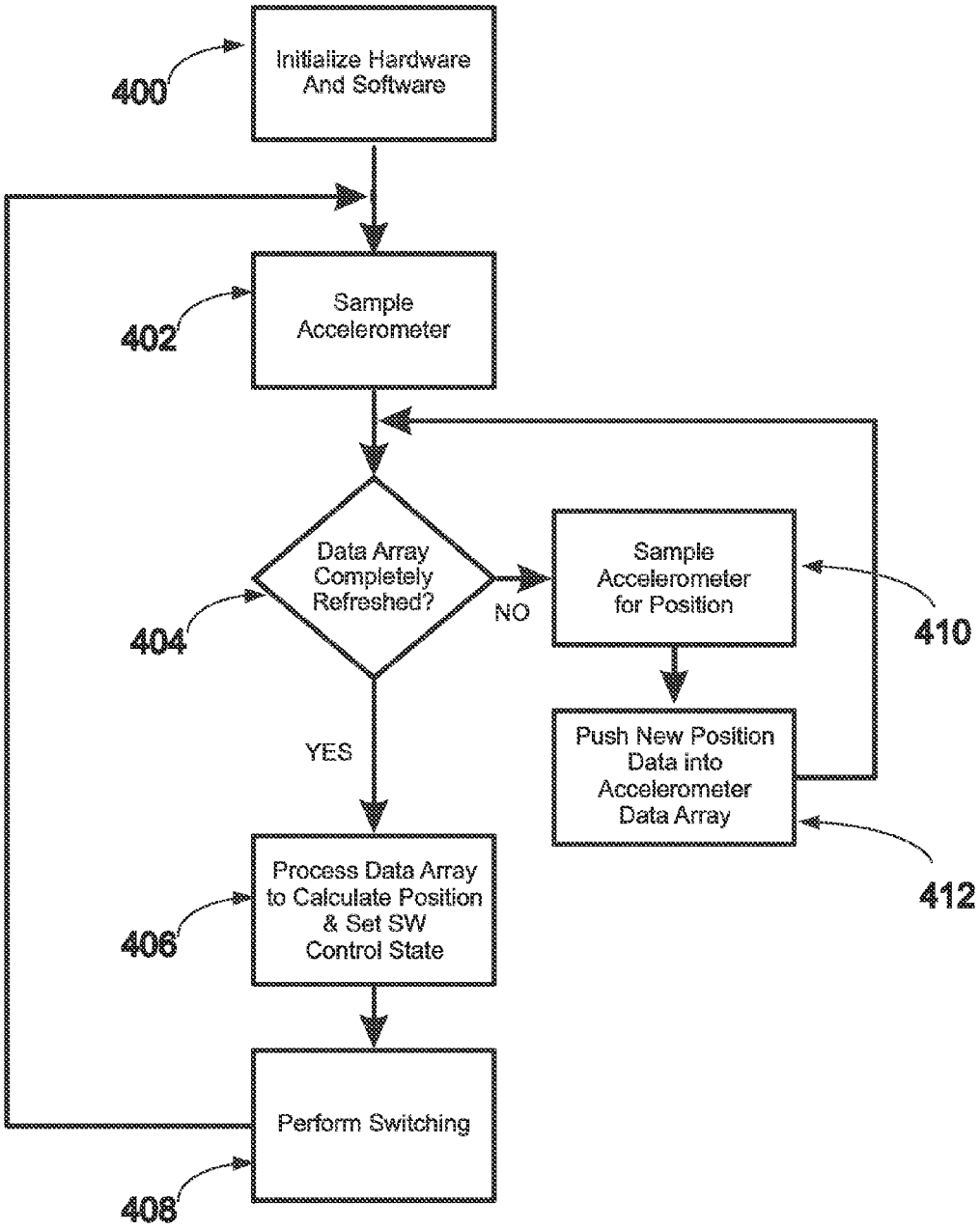
FIG. 4 is a flow diagram of the system software, according to an embodiment of the invention.

Referring now to FIG. 4, there is shown a flow diagram of the system software, according to an embodiment of the invention. In block 400, hardware and software is initialized. In various embodiments, this includes setting circuit elements to known states, initializing global variables, and clearing arrays. In block 402, the accelerometer is sampled to obtain a position or angle estimate. Block 404 determines if enough samples have been obtained to refresh the data array. If so, block 406 processes the data in the array to calculate an orientation and set the switch control state to the appropriate value that corresponds to that orientation. In various embodiments, the processing of the data array in block 406 includes hysteresis filtering to stabilize the switching rate. Block 408 then performs the switching based on the switch control state. The switching process is explained below in conjunction with FIG. 5. Control then loops back to block 402, where the process repeats.

At block 404, if a sufficient number of samples have not yet been obtained, a new sample is read from the accelerometer and then pushed into the data array at block 412. Control then passes back to block 404 for the process to continue.

The sampling rate for the accelerometer may be suitably chosen such that any lag time is not noticeable, yet slow enough that system resources are not overtaxed. In some embodiments, the sampling rate is in the range of 1000 samples per second to 100 samples per second. In some embodiments, these samples are stored in a data array of size 11 by 11.

Figure 5:
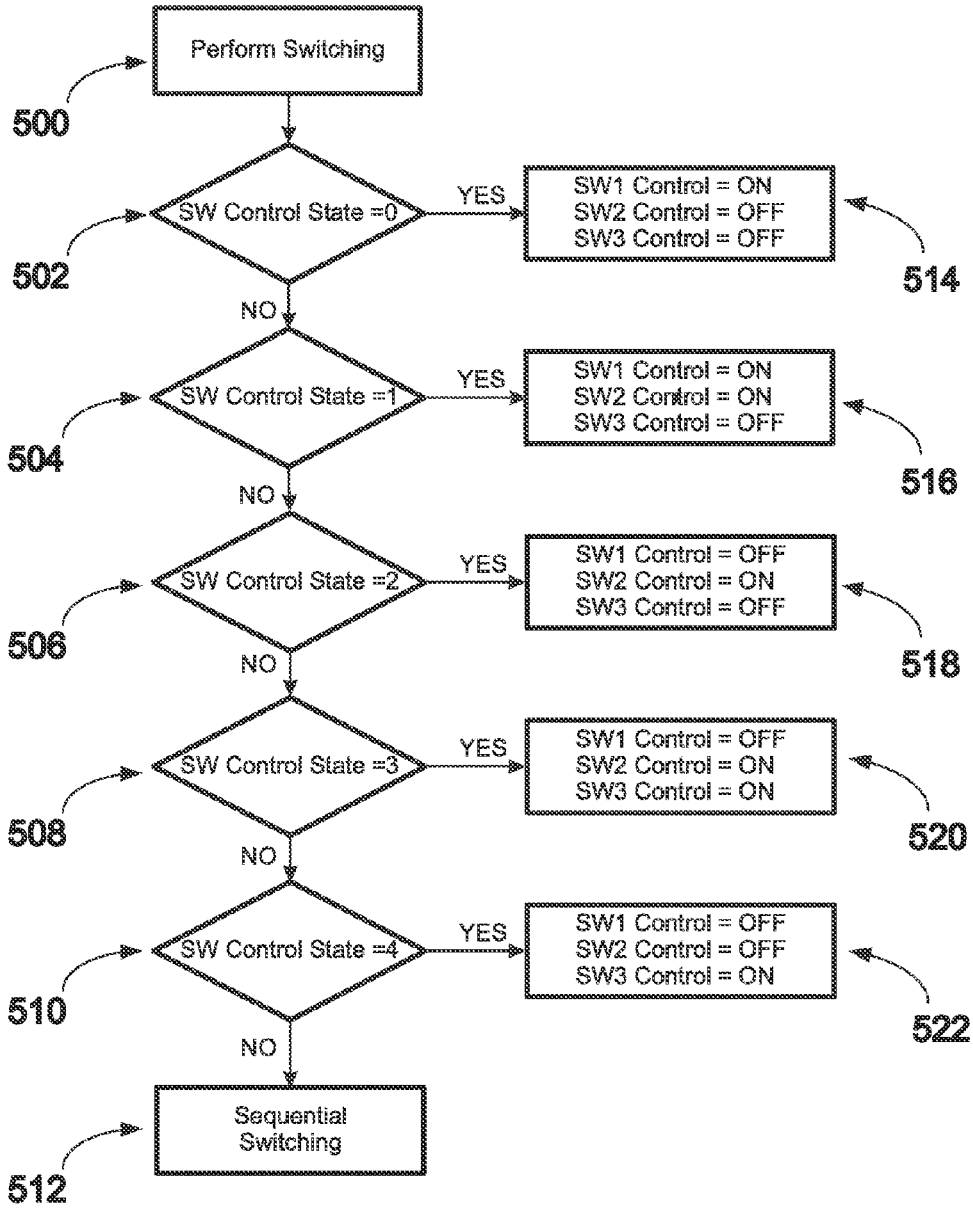
FIG. 5 is a flow diagram of the system software for performing switching, according to an embodiment of the invention.

Referring now to FIG. 5, there is shown a flow diagram of the system software for performing switching, according to an embodiment of the invention. Upon entering the "perform switching" process, as indicated in block 500, block 502 determines if the switch control state was set to zero. If so, block 514 sets switch 1 control on and switch 2 and 3 controls off. Block 504 determines if the switch control state was set to one. If so, block 516 sets switch 1 and 2 controls on and switch 3 control off. Block 506 determines if the switch control state was set to two. If so, block 518 sets switch 2 control on and switch 1 and 3 controls off. Block 508 determines if the switch control state was set to three. If so, block 520 sets switch 2 and 3 controls on and switch 1 control off. Block 510 determines if the switch control state was set to four. If so, block 522 sets switch 3 control on and switch 1 and 2 controls off. If switch control state is some other value then the sequential switching process is performed, which is explained below in conjunction with FIG. 6.

Figure 6:
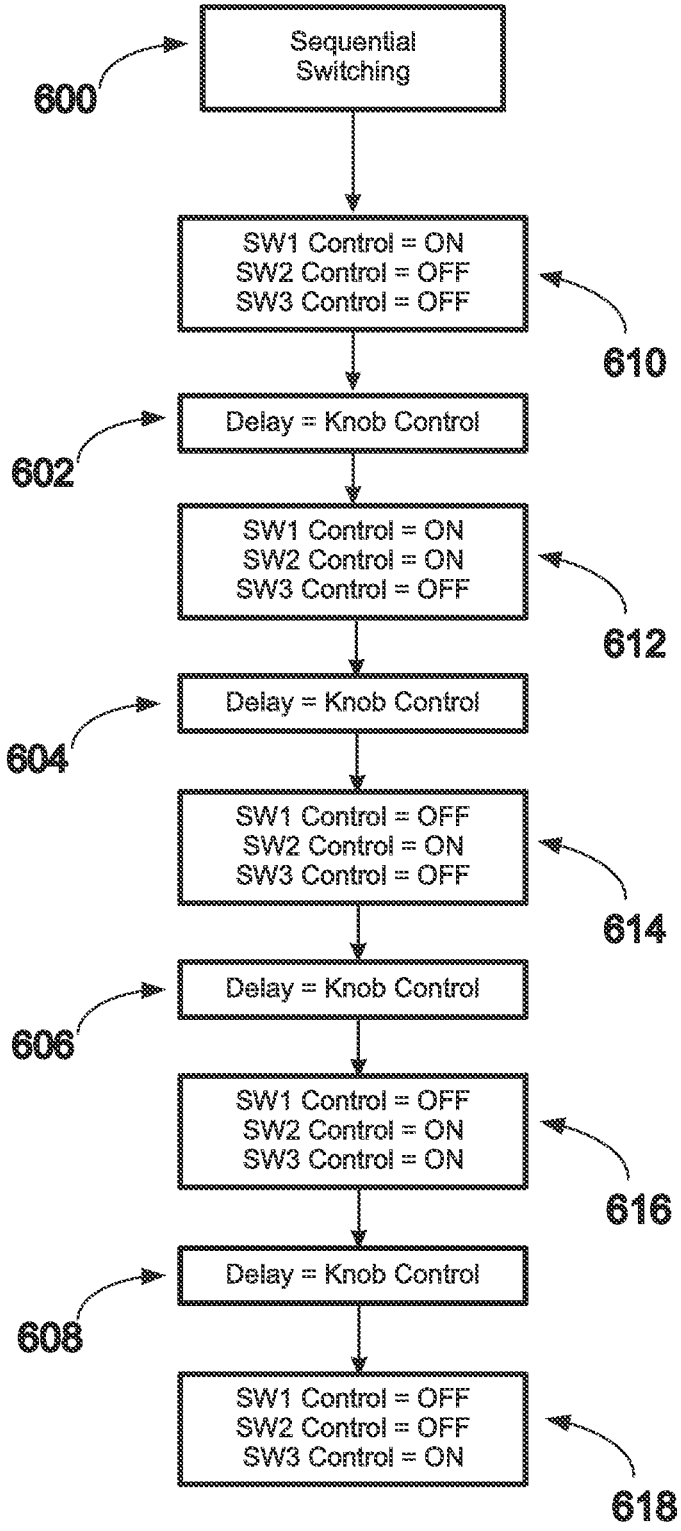
FIG. 6 is a flow diagram of the system software for sequential switching, according to an embodiment of the invention.

Referring now to FIG. 6, there is shown a flow diagram of the system software for sequential switching, according to an embodiment of the invention. Upon entering the "sequential switching" process, as indicated in block 600, block 610 sets switch 1 control on and switch 2 and 3 controls off. The process then waits for a period of time at block 602 where in some embodiments the delay is determined by a knob control. Block 612 then sets switch 1 and 2 controls on and switch 3 control off. The process waits for a period of time at block 604, where in some embodiments the delay is determined by a knob control. Block 614 then sets switch 2 control on and switch 1 and 3 controls off. The process waits for a period of time at block 606 where in some embodiments the delay is determined by a knob control. Block 616 then sets switch 2 and 3 controls on and switch 1 control off. The process waits for a period of time at block 608 where the delay is determined in some embodiments by a knob control. Block 618 then sets switch 3 control on and switch 1 and 2 controls off.

In certain embodiments, the sequential switching mode described above is initiated by pointing the neck of the guitar in the air at a steep angle. In other embodiments, the sequential switching mode is entered by manipulating a switch, knob, or other suitable control or signaling mechanism on the guitar.

Further embodiments of the invention enable pickups to be selected based on accelerometer measurements of motional speed, acceleration, or translational position in addition to or instead of static orientation.

In embodiments, different modes of operation can be selected. In some embodiments these operating modes include one or more of the following:

- standard/defeated, where the processor selects the pickups in standard mode and the pickups are manually selected in "defeated" mode;
- down=up and up=down, where in down=up mode pickup combinations in an ordered series of are assigned to orientations and/or positions of the instrument in a "down to up" order, and in "up=down" mode the pickup combinations are assigned in an "up to down" order;
- G-force mode, in which pickup combinations are selected according to smooth accelerations of the instrument; and/or
- "Jerk to Switch" mode, where pickup combinations are selected according to aggressive "snapping" movements of the instrument that might be encountered, for example when an active musician is jumping about on a stage.

Further embodiments of the invention include wireless connectivity between the processor in the guitar and a foot controller that interfaces with traditional effects pedals such as, for example, a Wah-Pedal. This enables the performer to control these additional effects with other types of guitar motions that the accelerometer can measure, such as movement fore and aft.

As will be realized, the invention is capable of other and different embodiments, and its several details are capable of modifications in various obvious respects, all without departing from the essence of the invention. For instance, the invention can be practiced as an apparatus and/or process, and can be scaled. There is within the scope of the invention, a guitar pickup switching system comprising an accelerometer to measure an angle of orientation of the guitar and a processor to control selection of a pickup based on the measured angle. The selection may be made based on a filtered version of a plurality of measured angles. The filtering may be a hysteresis filter. There may also be provided a manual pickup selection override switch.

There is also within the scope of the invention a method for switching a guitar pickup comprising measuring an angle of orientation of the guitar, whereby the measuring is performed by an accelerometer; selecting a pickup based on the measurement; and switching on the selected pickup.

The foregoing description of the embodiments of the invention has been presented for the purposes of illustration and description. It is not intended to be exhaustive or to limit the invention to the precise form disclosed. Many modifications and variations are possible in light of this disclosure. It is intended that the scope of the invention be limited not by this detailed description, but rather by the claims appended hereto.

What is claimed is:

1. A pickup switching system for a stringed instrument, comprising:

- a stringed instrument;
- a plurality of pickups that detect vibrations of strings at a plurality of locations on the instrument;
- a plurality of switches that are configured to direct outputs of the pickups to an audio amplifier system;

an accelerometer fixed to the stringed instrument, where the term "accelerometer" refers herein to any device or sensor that is configured to determine at least one of an angular orientation, an acceleration, and a position of the stringed instrument; and a processor in electronic communication with the switches and the accelerometer, the processor being programmable so as to select different combinations of the pickups for output to the audio amplifier system according to measurements obtained from the accelerometer.

2. The pickup switching system of claim 1, wherein the stringed instrument is an electric guitar.

3. The pickup switching system of claim 1, wherein at least one of the pickup combinations is selected according to a comparison of an orientation of the instrument with a plurality of selectable orientation ranges.

4. The pickup switching system of claim 1, wherein the processor can select up to five pickup combination corresponding to five ranges of accelerometer measurements.

5. The pickup switching system of claim 3, wherein the number of selectable ranges of accelerometer measurements can be changed by a user.

6. The pickup switching system of claim 1, wherein the pickup combinations are selected based on applying a filter to a plurality of accelerometer measurements.

7. The pickup switching system of claim 6, wherein the filter is simple averaging of sample values.

8. The pickup switching system of claim 6, wherein the filter is a hysteresis filter.

9. The pickup switching system of claim 6, wherein a output of the filter reacts slowly to changing inputs by taking into account a recent history of those inputs.

10. The pickup switching system of claim 1, further comprising a manual pickup selection control that is configured to override the processor and manually select at least one combination of pickups for output to the audio amplifier system.

11. The pickup switching system of claim 1, wherein at least one of the accelerometer, the processor, and the switches is located within a hollow portion of the instrument.

12. The pickup switching system of claim 1, wherein the processor is configured to be programmed by activating a training mode of the processor and then storing training points in the processor by activating a training control during manipulation of the instrument, each training point corresponding to a specific combination of pickups to be selected.

13. The pickup switching system of claim 12, wherein for each training point the corresponding combination of pickups is defined by selecting the combination of pickups using a manual pickup selection control.

14. The pickup switching system of claim 1, wherein the accelerometer is sampled at a sampling rate that is between 1000 samples per second and 100 samples per second.

15. The pickup switching system of claim 1, wherein data obtained by sampling the accelerometer are stored in a data array of size 11 by 11.

16. The pickup switching system of claim 1, wherein the processor is able to initiate a sequential switching process whereby combinations of pickups included in a specified sequence are sequentially selected at times separated by one or more specified time intervals.

17. The pickup switching system of claim 16, wherein the sequential switching process can be initiated by manipulating a control or signaling mechanism.

18. The pickup switching system of claim 1, wherein at least one of the pickup combinations is selected according to measurements of motional speed or acceleration obtained from the accelerometer.

19. The pickup switching system of claim 1, wherein selectable modes of operation of the processor include at least one of:

processor controlled switching;

manually controlled switching;

selection of pickup combinations from an ordered series of combinations in ascending order;

selection of pickup combinations from an ordered series of combinations in descending order;

switching according to slow movements of the instrument; and switching according to rapid movements of the instrument.

20. The pickup switching system of claim 1, wherein at least one of the pickup combinations is selected according to a measurement of a translational position of the instrument.

21. The pickup switching system of claim 20, wherein the translational position of the instrument is measured relative to a position of a foot pedal in wireless communication with the processor.

22. A method for switching between combinations of pickups that detect string vibrations on a stringed instrument, the method comprising:

measuring at least one of an angular position, an acceleration, a rate of motion, and a translational position of the stringed instrument through use of an accelerometer fixed to the stringed instrument;

selecting a combination of pickups according to the measurement; and directing outputs of the selected combination of pickups to an audio amplifier system.

* * * * *